US006728503B2

(12) United States Patent
Stelter et al.

(10) Patent No.: US 6,728,503 B2
(45) Date of Patent: Apr. 27, 2004

(54) ELECTROPHOTOGRAPHIC IMAGE DEVELOPING PROCESS WITH OPTIMIZED AVERAGE DEVELOPER BULK VELOCITY

(75) Inventors: Eric C. Stelter, Pittsford, NY (US); Joseph E. Guth, Holley, NY (US); Matthias H. Regelsberger, Rochester, NY (US); Edward M. Eck, Lima, NY (US); Ulrich Mutze, Bad Ditzenbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/855,985

(22) Filed: May 15, 2001

(65) Prior Publication Data

US 2002/0168200 A1 Nov. 14, 2002

Related U.S. Application Data

(60) Provisional application No. 60/277,876, filed on Mar. 22, 2001, and provisional application No. 60/287,583, filed on Feb. 28, 2001.

(51) Int. Cl.[7] ..... G03G 15/09
(52) U.S. Cl. ..... 399/267; 430/122
(58) Field of Search ..... 399/236, 267, 399/270, 276, 277; 430/122

(56) References Cited

U.S. PATENT DOCUMENTS

| | | | |
|---|---|---|---|
| 4,473,029 | A | 9/1984 | Fritz et al. |
| 4,496,643 | A | 1/1985 | Wilson et al. |
| 4,531,832 | A | 7/1985 | Kroll et al. |
| 4,546,060 | A | 10/1985 | Miskinis et al. |
| 4,602,863 | A | 7/1986 | Fritz et al. |
| 4,634,286 | A | 1/1987 | Pike |
| 4,637,973 | A | 1/1987 | Shigeta et al. |
| 4,671,207 | A | 6/1987 | Hilbert |
| 4,714,046 | A | 12/1987 | Steele et al. |
| 4,764,445 | A | 8/1988 | Miskinis et al. |
| 4,825,244 | A | 4/1989 | Hediger |
| 4,887,132 | A | 12/1989 | Joseph et al. |
| 4,922,302 | A | 5/1990 | Hill et al. |
| 4,949,127 | A | 8/1990 | Matsuda et al. |
| 4,967,236 | A | 10/1990 | Rodenberg et al. |

(List continued on next page.)

FOREIGN PATENT DOCUMENTS

| | | | |
|---|---|---|---|
| EP | 1237052 A2 * | 9/2002 | ..... G03G/15/09 |
| JP | 03-170978 | 7/1991 | |
| JP | 04-097268 | 3/1992 | |
| JP | 10-161423 | 6/1998 | |
| WO | WO 85/00438 | 1/1985 | |

OTHER PUBLICATIONS

U.S. Patent Application No. 10/403,539 (Jadwin et al.) Attorney Docket No. 10003DIV(3080–002–01).

"Modelling the atomic structure", Amorphous Metallic Alloys, Chapter 4 (1983 Butterworths).

*Primary Examiner*—Robert Beatty

(57) ABSTRACT

Apparatus and methods for electrographic image development, wherein the image development process is optimized by setting the average developer bulk flow velocity with reference to the imaging member velocity, for example, where the average developer bulk velocity is about the same as the imaging member velocity, or within preferred ranges, such as between about 40% to about 130% of the imaging member velocity.

72 Claims, 3 Drawing Sheets

U.S. PATENT DOCUMENTS 5,001,028 A 3/1991 Mosehauer et al.
5,019,796 A 5/1991 Lee et al.
5,040,003 A 8/1991 Willis
5,043,760 A 8/1991 MacLellan et al.
5,047,807 A 9/1991 Kalyandurg
5,049,471 A 9/1991 Higashiguchi et al.
5,061,586 A 10/1991 Saha et al.
5,063,399 A 11/1991 Zeman et al.
5,066,981 A 11/1991 Kalyandurg
5,084,739 A 1/1992 Kalyandurg et al.
5,095,340 A 3/1992 Mahoney
5,104,761 A 4/1992 Saha et al.
5,106,714 A 4/1992 Saha et al.
5,111,245 A 5/1992 DeCecca et al.
5,132,732 A 7/1992 Kalyandurg et al.
5,138,388 A 8/1992 Kamp et al.
5,146,278 A 9/1992 Kroll et al.
5,148,220 A 9/1992 Hilbert et al.
5,162,854 A 11/1992 Hilbert et al.
5,182,608 A 1/1993 Kroll et al.
5,184,194 A 2/1993 Mosehauer et al.
5,190,841 A 3/1993 Saha et al.
5,190,842 A 3/1993 Saha et al.
5,196,887 A 3/1993 Hilbert et al.
5,227,265 A 7/1993 DeBoer et al.
5,237,127 A 8/1993 DeCecca et al.
5,239,342 A 8/1993 Kubo et al.
5,241,327 A 8/1993 Rubin et al.
5,245,388 A 9/1993 Rydelek et al.
5,247,331 A 9/1993 Rydelek
5,255,053 A 10/1993 Green et al.
5,268,249 A 12/1993 Saha et al.
5,268,719 A 12/1993 Rydelek et al.
5,280,302 A 1/1994 Rubin et al.
5,282,002 A 1/1994 Jacobs et al.
5,291,259 A 3/1994 Weitzel et al.
5,293,201 A 3/1994 Kamp et al.
5,296,894 A 3/1994 Green et al.
5,296,898 A 3/1994 Rubin et al.
5,296,905 A 3/1994 Yousey et al.
5,298,358 A 3/1994 Rubin et al.
5,300,988 A 4/1994 Westbrook et al.
5,306,592 A 4/1994 Saha
5,313,993 A 5/1994 Corby et al.
5,325,161 A 6/1994 Saha et al.
5,332,645 A 7/1994 Saha et al.
5,339,140 A 8/1994 Zeman et al.
5,344,731 A 9/1994 Deboer et al.
5,347,345 A 9/1994 Osterhoudt
5,347,347 A 9/1994 Hilbert et al.
5,376,492 A 12/1994 Stelter et al.
5,400,124 A 3/1995 Kass et al.
5,409,791 A 4/1995 Kaukeinen et al.
5,484,680 A 1/1996 Goto et al.
5,489,975 A 2/1996 Kaukeinen et al.
5,500,320 A 3/1996 Saha
5,512,404 A 4/1996 Saha
5,592,268 A 1/1997 Uehara et al.
5,640,656 A 6/1997 Hilbert et al.
5,701,550 A 12/1997 Lofftus et al.
5,705,307 A 1/1998 Tyagi et al.
5,713,064 A 1/1998 Kasiske et al.
5,732,311 A 3/1998 May et al.
5,748,218 A 5/1998 Stelter et al.
5,835,832 A 11/1998 Rimai et al.
5,853,941 A 12/1998 Rimai et al.
5,923,933 A 7/1999 Anzai et al.
5,923,937 A 7/1999 Thompson et al.
5,926,679 A 7/1999 May et al.
5,998,076 A 12/1999 Mahabadi et al.
6,125,257 A 9/2000 Sekine et al.
6,526,247 B2 2/2003 Stelter et al.
6,610,451 B2 8/2003 Jadwin et al.
2003/0091921 A1 5/2003 Stelter

* cited by examiner

ELECTROPHOTOGRAPHIC IMAGE DEVELOPING PROCESS WITH OPTIMIZED AVERAGE DEVELOPER BULK VELOCITY

This application claims the benefit of two provisional applications: Ser. Nos. 60/277,876 filed Mar. 22, 2001, and 60/287,583 filed Feb. 28, 2001.

BACKGROUND OF THE INVENTION

The invention relates generally to processes for electrographic image development. More specifically, the invention relates to apparatus and methods for electrographic image development, wherein the image development process is optimized by setting the average developer bulk velocity with reference to the imaging member velocity.

Processes for developing electrographic images using dry toner are well known in the art and are used in many electrographic printers and copiers. The term "electrographic printer," is intended to encompass electrophotographic printers and copiers that employ a photoconductor element, as well as ionographic printers and copiers that do not rely upon a photoconductor. Electrographic printers typically employ a developer having two or more components, consisting of resinous, pigmented toner particles, magnetic carrier particles and other components. The developer is moved into proximity with an electrostatic image carried on an electrographic imaging member, whereupon the toner component of the developer is transferred to the imaging member, prior to being transferred to a sheet of paper to create the final image. Developer is moved into proximity with the imaging member by an electrically-biased, conductive toning shell, often a roller that may be rotated co-currently with the imaging member, such that the opposing surfaces of the imaging member and toning shell travel in the same direction. Located adjacent the toning shell is a multipole magnetic core, having a plurality of magnets, that may be fixed relative to the toning shell or that may rotate, usually in the opposite direction of the toning shell.

The developer is deposited on the toning shell and the toning shell rotates the developer into proximity with the imaging member, at a location where the imaging member and the toning shell are in closest proximity, referred to as the "toning nip." In the toning nip, the magnetic carrier component of the developer forms a "nap," similar in appearance to the nap of a fabric, on the toning shell, because the magnetic particles form chains of particles that rise vertically from the surface of the toning shell in the direction of the magnetic field. The nap height is maximum when the magnetic field from either a north or south pole is perpendicular to the toning shell. Adjacent magnets in the magnetic core have opposite polarity and, therefore, as the magnetic core rotates, the magnetic field also rotates from perpendicular to the toning shell to parallel to the toning shell. When the magnetic field is parallel to the toning shell, the chains collapse onto the surface of the toning shell and, as the magnetic field again rotates toward perpendicular to the toning shell, the chains also rotate toward perpendicular again. Thus, the carrier chains appear to flip end over end and "walk" on the surface of the toning shell and, when the magnetic core rotates in the opposite direction of the toning shell, the chains walk in the direction of imaging member travel.

The prior art indicates that it is preferable to match developer linear velocity to the imaging member velocity. Prior art printers have attempted to relate the velocity of the developer to the velocity of the imaging member by measuring the surface velocity, or linear velocity, of the developer, based on high speed camera measurements of the velocity of the ends of the carrier chains. This invention, however, is based on the surprising recognition that such measurements based on linear velocity greatly overestimate the actual developer velocity, thereby causing a substantial mismatch in velocity of the developer and imaging member. This overestimation results from a focus on the surface of the developer nap, i.e., the ends of the carrier chains, because as the carrier chain rotates from parallel to the toning shell to perpendicular to the toning shell, the ends of the carrier chains accelerate, causing the surface of the developer nap to appear to move at a higher velocity than the greater volume of the developer. While mismatched developer and imaging member velocities may produce adequate image quality for some applications, as the speed of image production increases, mismatched developer bulk and imaging member velocities may lead to image quality problems. Accordingly, it is an object of the present invention to provide an electrographic printer in which the average developer bulk velocity is about the same as the imaging member velocity.

SUMMARY

The present invention solves these and other shortcomings of the prior art by providing a method and apparatus for generation of electrographic images in which the average developer bulk velocity is within preferred ranges relative to the imaging member velocity. In one embodiment, the invention provides an electrographic printer, including an imaging member moving at a predetermined velocity, a toning shell located adjacent the imaging member and defining an image development area therebetween, and a multipole magnetic core located adjacent the toning shell, wherein developer is caused to move through the image development area in the direction of imaging member travel at an average developer bulk velocity greater than about 37% of the imaging member velocity. In another embodiment, the average developer bulk velocity is greater than about 50% of the imaging member velocity. In a further embodiment, the average developer bulk velocity is greater than about 75% of the imaging member velocity. In a yet further embodiment, the average developer bulk velocity is greater than about 90% of the imaging member velocity. In a still further embodiment, the average developer bulk velocity is between 40% and 130% of the imaging member velocity, and preferably between 90% and 110% of the imaging member velocity. In another embodiment, the average developer bulk velocity is substantially equal to the imaging member velocity. In yet another embodiment, the electrographic printer includes a cylindrical magnetic core or other configuration of magnetic field producing means that produces a magnetic field having a field vector in the toning nip that rotates in space.

A further embodiment is a method for generating electrographic images, the method including providing an electrographic printer comprising an imaging member moving at a predetermined velocity, a toning shell located adjacent the imaging member and defining an image development area therebetween, and a multipole magnetic core located inside the toning shell, and causing developer to move through the image development area in the direction of imaging member travel at an average developer bulk velocity greater than about 37% of the imaging member velocity. In a further embodiment, the average developer bulk velocity is greater than about 50% of the imaging member velocity. In another embodiment, the average developer bulk velocity is greater than about 75% of the imaging member velocity. In a further embodiment, the average developer bulk velocity is greater than about 90% of the imaging member velocity. Preferably, the average developer bulk velocity is between about 40% and about 130% of the imaging member velocity, and more preferably between about 90% and about 110% of the imaging member velocity. In a still further embodiment, the average developer bulk velocity is substantially equal to the imaging member velocity.

An additional embodiment provides an electrographic printer including an imaging member moving at a predetermined velocity, a toning shell located adjacent the imaging member and defining an image development area therebetween, and a multipole magnetic core located adjacent the toning shell, wherein developer is caused to move through the image development area in the direction of imaging member travel at an average developer bulk velocity wherein the developer flow in gm/(in. sec.) divided by the developer mass area density in $gm/in^2$ is greater than about 37% of the imaging member velocity. In a further embodiment, the developer is caused to move through the image development area in the direction of imaging member travel at an average developer bulk velocity wherein the developer flow in gm/(in. sec.) divided by the developer mass area density in $gm/in^2$ is between about 90% and 110% of the imaging member velocity.

An additional embodiment provides an electrographic printer including an imaging member moving at a predetermined velocity, a toning shell located adjacent the imaging member and defining an image development area therebetween, and a multipole magnetic core located adjacent the toning shell, wherein developer is caused to move through the image development area in the direction of imaging member travel at a rate with excess free volume in the image development area to be between about 7% and about 93%, preferably between about 25% and about 75%, and more preferably about 50%. In another embodiment, the fraction of excess free volume is determined by the equation $V_F=1-(kN_TV_T+N_CV_C)/(fL)$, wherein k is between about 0.0 and about 1.0. In yet another embodiment, the fraction of excess free volume is determined by the equation $V_F=1-(kN_Tj V_C+N_CV_C)/(fH)$, wherein k is between about 0.0 and about 1.0 and j is between $V_T/V_C$ and 1.0.

An additional embodiment provides a method for generating electrographic images including providing an electrographic printer comprising an imaging member moving at a predetermined velocity, a toning shell located adjacent the imaging member, and defining an image development area therebetween, and a multipole magnetic core located inside the toning shell and causing developer to move through the image development area in the direction of imaging member travel at an average developer bulk velocity such that there is substantially no relative motion in the process direction of the developer with reference to the imaging member, wherein the developer is caused to move in a direction normal to the direction of developer bulk flow.

DETAILED DESCRIPTION OF THE FIGURES AND PREFERRED EMBODIMENTS

Figure 1:
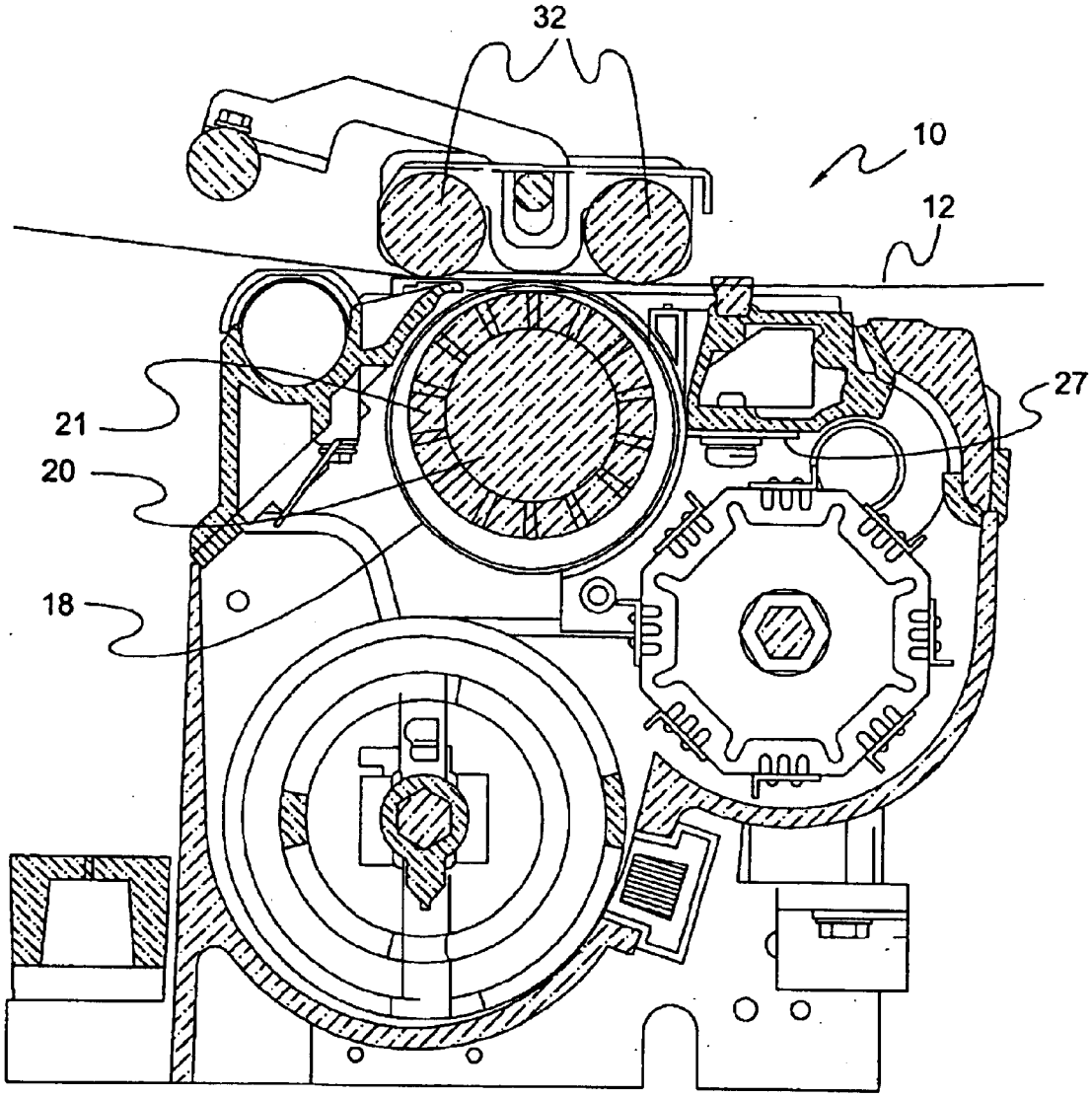
FIG. 1 presents a side view of an apparatus for developing electrographic images, according to an aspect of the invention.
Figure 2:
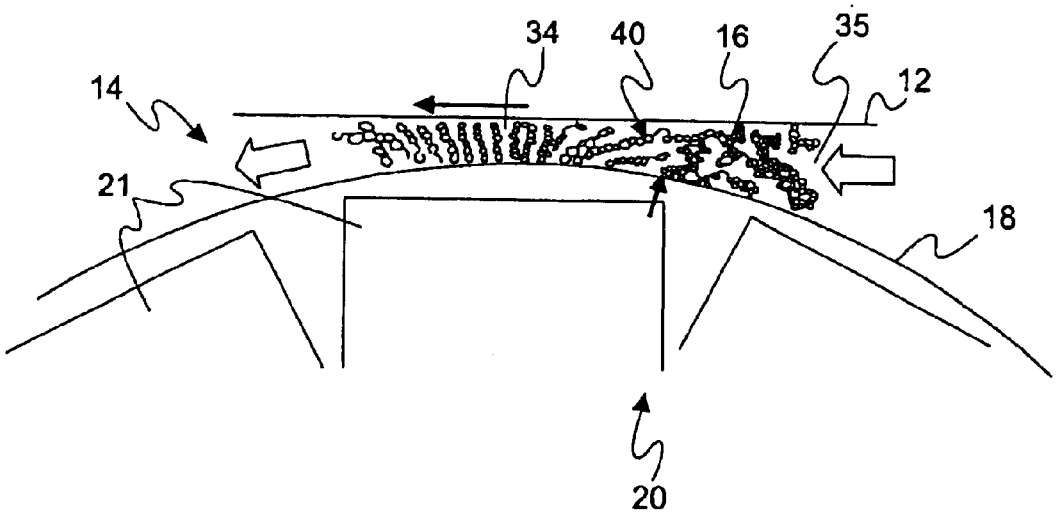
FIG. 2 presents a side cross-sectional view of an apparatus for developing electrographic images, according to an aspect of the present invention.

Various aspects of the invention are presented in FIGS. 1–5, which are not drawn to scale, and wherein like components in the numerous views are numbered alike. FIGS. 1 and 2 depict an exemplary electrographic printing apparatus according to an aspect of the invention. An apparatus 10 for developing electrographic images is presented comprising an electrographic imaging member 12 on which an electrostatic image is generated, and a magnetic brush 14 comprising a rotating toning shell 18, a mixture 16 of hard magnetic carriers and toner (also referred to herein as "developer"), and a magnetic core 20. In a preferred embodiment, the magnetic core 20 comprises a plurality of magnets 21 of alternating polarity, located inside the toning shell 18 and rotating in the opposite direction of toning shell rotation, causing the magnetic field vector to rotate in space relative to the plane of the toning shell. Alternative arrangements are possible, however, such as an array of fixed magnets or a series of solenoids or similar devices for producing a magnetic field. Likewise, in a preferred embodiment, the imaging member 12 is a photoconductor and is configured as a sheet-like film. However, the imaging member may be configured in other ways, such as a drum or as another material and configuration capable of retaining an electrostatic image, used in electrophotographic, ionographic or similar applications. The film imaging member 12 is relatively resilient, typically under tension, and a pair of backer bars 32 may be provided that hold the imaging member in a desired position relative to the toning shell 18, as shown in FIG. 1. A metering skive 27 may be moved closer to or further away from the toning shell 18 to adjust the amount of toner delivered.

In a preferred embodiment, the imaging member 12 is rotated at a predetermined imaging member 12 velocity in the process direction, i.e., the direction in which the imaging member travels through the system, and the toning shell 18 is rotated with a toning shell 18 surface velocity adjacent and co-directional with the imaging member 12 velocity. The toning shell 18 and magnetic core 20 bring the developer 16, comprising hard magnetic carrier particles and toner particles into contact with the imaging member 12. The imaging member 12 contains a dielectric layer and a conductive layer, is electrically grounded and defines a ground plane. The surface of the imaging member 12 facing the toning shell 18 can be treated at this point in the process as an electrical insulator with imagewise charge on its surface, while the surface of the toning shell 18 opposite that is an electrical conductor. Biasing the toning shell 18 relative to ground with a voltage creates an electric field that attracts toner particles to the electrographic image with a uniform toner density, the electric field being a maximum where the toning shell 18 is adjacent the imaging member 12.

The imaging member 12 and the toning shell 18 define an area therebetween known as the toning nip 34, also referred to herein as the image development area. Developer 16 is delivered to the toning shell 18 upstream from the toning nip 34 and, as the developer 16 is applied to the toning shell 18, the average velocity of developer 16 through the narrow toning nip 34 is initially less than the developer 16 velocity on other parts of the toning shell 18. Therefore, developer 16 builds up immediately upstream of the toning nip 34, in a so-called rollback zone 35, until sufficient pressure is generated in the toning nip 34 to compress the developer 16 to the extent that it moves at the same bulk velocity as the developer 16 on the rest of the toning shell 18.

According to an aspect of the invention, the magnetic brush 14 operates according to the principles described in U.S. Pat. Nos. 4,473,029 and 4,546,060, the contents of which are fully incorporated by reference as if set forth herein. The two-component dry developer composition of U.S. Pat. No. 4,546,060 comprises charged toner particles and oppositely charged, magnetic carrier particles, which comprise a magnetic material exhibiting "hard" magnetic properties, as characterized by a coercivity of at least 300 gauss and also exhibit an induced magnetic moment of at least 20 EMU/gm when in an applied field of 1000 gauss, as disclosed. In a preferred embodiment, the toning station has a nominally 2" diameter stainless steel toning shell containing a magnetic core having fourteen poles, adjacent magnets alternating between north and south polarity. Each alternating north and south pole has a field strength of approximately 1000 gauss. The toner particles have a nominal diameter of 11.5 microns, while the hard magnetic carrier particles have a nominal diameter of approximately 26 microns and resistivity of $10^{11}$ ohm-cm. Although described in terms of a preferred embodiment involving a rotating, multipole magnetic core, it is to be understood that the invention is not so limited, and could be practiced with any apparatus that subjects the carrier particles to a magnetic field vector that rotates in space or to a magnetic field of alternating direction, as for example, in a solenoid array.

Figure 3:
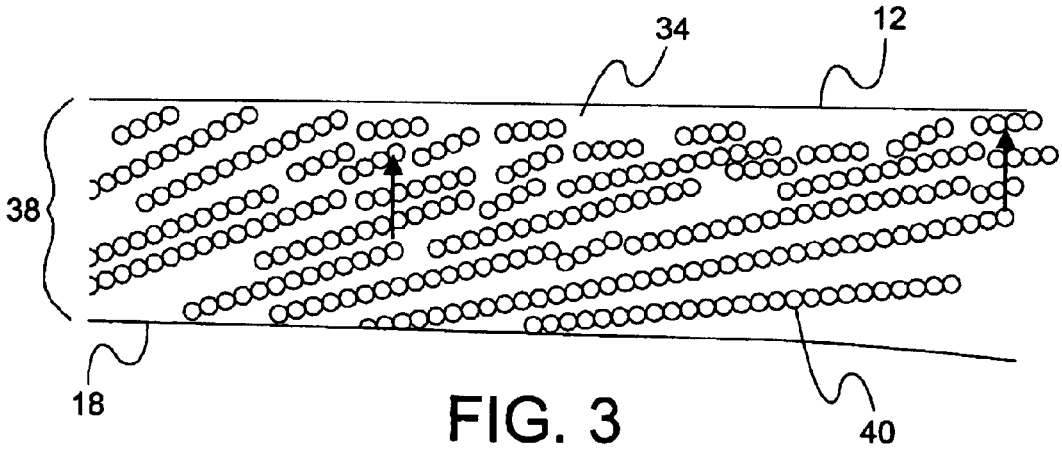
FIG. 3 presents a diagrammatic view of the toning nap created by the operation of the apparatus depicted in FIG. 2.

As depicted diagrammatically in FIG. 3, when hard magnetic carrier particles are employed, the carrier particles form chains 40 under the influence of a magnetic field created by the rotating magnetic core 20, resulting in formation of a nap 38 as the magnetic carrier particles form chains of particles that rise from the surface of the toning shell 18 in the direction of the magnetic field, as indicated by arrows. The nap 38 height is maximum when the magnetic field from either a north or south pole is perpendicular to the toning shell 18, however, in the toning nip 34, the nap 38 height is limited by the spacing between the toning shell 18 and the imaging member 12. As the magnetic core 20 rotates, the magnetic field also rotates from perpendicular to the toning shell 18 to parallel to the toning shell 18. When the magnetic field is parallel to the toning shell 18, the chains 40 collapse onto the surface of the toning shell 18 and, as the magnetic field again rotates toward perpendicular to the toning shell 18, the chains 40 also rotate toward perpendicular again.

Each flip, moreover, as a consequence of both the magnetic moment of the particles and the coercivity of the magnetic material, is accompanied by a rapid circumferential step by each particle in a direction opposite the movement of the magnetic core 20. Thus, the carrier chains 40 appear to flip end over end and "walk" on the surface of the toning shell 18. In reality, the chains 40 are forming, rotating, collapsing and re-forming in response to the pole transitions caused by the rotation of the magnetic core 20, thereby also agitating the developer 16, freeing up toner to interact with an electrostatic image carried by the imaging member 12, as discussed more fully below. When the magnetic core 20 rotates in the opposite direction of the toning shell 18, the chains 40 walk in the direction of toning shell 18 rotation and, thus, in the direction of imaging member 12 travel. The observed result is that the developer flows smoothly and at a rapid rate around the toning shell 18 while the magnetic core 20 rotates in the opposite direction, thus rapidly delivering fresh toner to the imaging member 12 and facilitating high-volume copy and printer applications.

Figure 4:
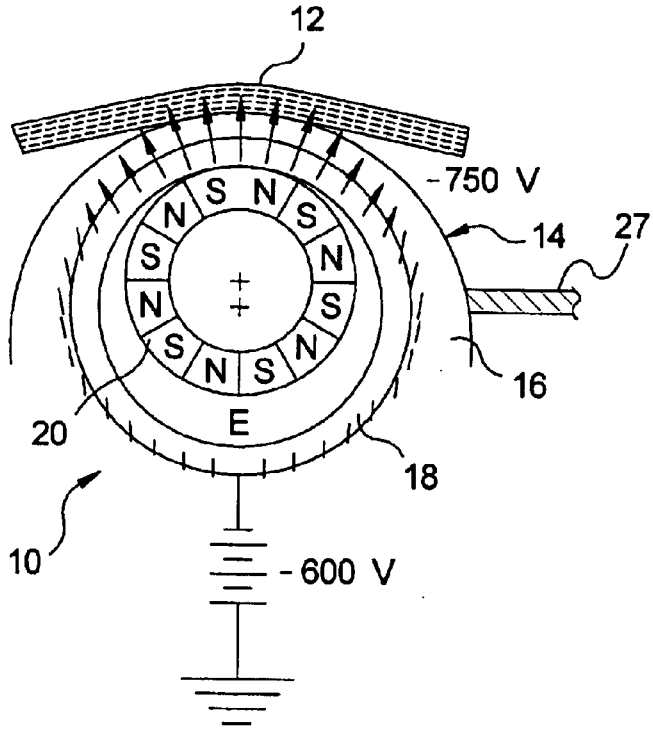
FIG. 4 presents a side schematic view of a discharged area development configuration of the FIG. 1 apparatus with a background area passing over a magnetic brush.
Figure 5:
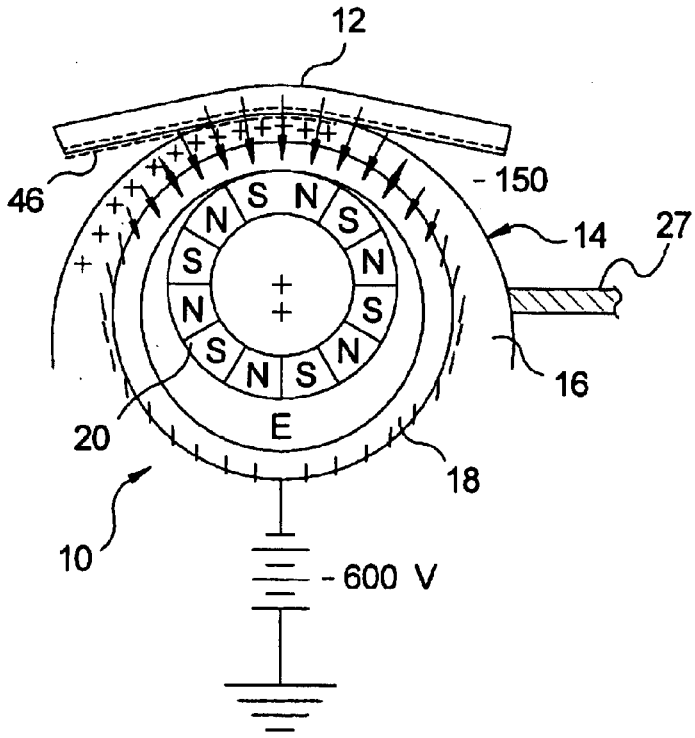
FIG. 5 presents a side schematic view of a discharged area development configuration of the FIG. 1 apparatus with an area that is being toned passing over a magnetic brush.

This aspect of the invention is explained more fully with reference to FIGS. 4 and 5, wherein the apparatus 10 is presented in a configuration for Discharged Area Development (DAD). Cross-hatching and arrows indicating movement are removed for the sake of clarity. FIG. 4 represents development of a background area (no toner deposited), and FIG. 5 represents development of a toned area (toner deposited). Referring specifically to FIG. 4, the surface of the imaging member 12 is charged using methods known in the electrographic imaging arts to a negative static voltage, −750 VDC, for example, relative to ground. The shell is biased with a lesser negative voltage, −600 VDC, for example, relative to ground. The difference in electrical potential generates an electric field E that is maximum where the imaging member 12 is adjacent the shell 18. The electric field E is presented at numerous locations proximate the surface of the shell 18 with relative strength indicated by the size of the arrows. The toner particles are negatively charged in a DAD system, and are not drawn to the surface of the imaging member 12. However, the toner particles are drawn to the surface of the shell 18 where the electric field E is maximum (adjacent the imaging member 12).

Referring now to FIG. 5, the apparatus 10 of FIGS. 1 and 2 is shown with a discharged area of the imaging member 12 passing over the magnetic brush 14. The static voltage of −750 VDC on imaging member 12 has been discharged to a lesser static voltage, −150 VDC, for example, by methods known in the art such as a laser or LED printing head, without limitation. The sense of the electric field E is now reversed, and negative toner particles 46 are attracted to and adhere to the surface of the imaging member. A residual positive charge is developed in the mixture 16, which is carried away by the flow of the mixture 16. Although described in relation to a DAD system, the principles described herein are equally applicable to a charged area development (CAD) system with positive toner particles.

Referring again to FIGS. 1–3, as discussed above, for optimal toning, the average bulk velocity of the developer 16 should be matched to the imaging member 12 velocity. While not wishing to be bound to a particular theory, it is currently believed that the motion of the carrier chains 40 has another important influence on toning, in that when the chains 40 are rotating in the direction of the imaging member 12, the particles at the end of the chains 40 are impelled in a direction perpendicular to the imaging member 12, indicated by arrows in FIG. 3, imparting a developer 16 velocity component in this direction, perpendicular to the direction of developer 16 bulk flow. Additionally, as the chains 40 move in this manner, any free developer 16 particles or clusters of developer 16 particles are "levered" in the direction of the imaging member 12, causing even free toner particles to be impelled in the direction of the imaging member.

If the average developer 16 bulk velocity is exactly equal to the imaging member 12 velocity, there is no average relative motion between the developer 16 and the imaging member 12 in the direction parallel to the imaging member 12, i.e., the "process direction," and the instantaneous relative velocity in the process direction of carrier particles relative to the imaging member 12 surface is essentially zero. On the other hand, if the average developer 16 bulk velocity in the process direction is much slower or much faster than the imaging member 12 velocity, an average developer 16 velocity component parallel to the imaging member 12 is introduced, resulting in collisions with carrier particles moving parallel to the imaging member 12. Such collisions cause the toner particle(s) bound to the carrier particle to become freed, moving substantially parallel to the imaging member 12, interacting with the imaging member 12, particularly where the external field is low, such as background areas, and causing potentially severe image quality problems. When there is no average relative motion between the developer 16 and the imaging member 12 in the process direction, the toner particles remain under the influence of the external electric field and are directed by the field toward or away from the imaging member 12, depending on the charge on a particular area of the imaging member 12. Additionally, during the development process, toner is deposited onto the electrostatic image carried by the imaging member 12 and scavenged back into the developer 16 simultaneously. By matching the actual average bulk velocity of the developer 16 with the velocity of the imaging member 12, such scavenging is minimized. Accordingly, in a preferred embodiment, the average developer 16 bulk velocity is within preferred ranges with respect to the imaging member 12 velocity. Preferably, the average developer bulk velocity is within the range of about 40% to about 130% of the imaging member 12 velocity and, more preferably is between about 75% to about 125% of the imaging member 12 velocity, more preferably, is between about 90% to about 110% of the imaging member 12 velocity, and in a preferred embodiment is substantially equal to the imaging member 12 velocity.

Accordingly, in an aspect of the invention, optimal average developer bulk velocity is calculated for a given setpoint profile and the optimal settings for the toning shell 18 speed and magnetic core 20 speed are calculated to allow the average developer bulk velocity at those settings to be matched to the imaging member 12 velocity. Several factors affect the actual average developer bulk velocity, none of which are accounted for in prior art calculations of developer linear velocity. First, the movement of the developer and, thus, the average developer bulk flow velocity, can be seen as the sum of the rotation of the toning shell 18 carrying the developer 16, and the movement resulting from walking of the carrier chains 40 in response to pole transitions of the rotating magnetic core 20. These terms are summed because rotation of the toning shell 18 increases the frequency of pole transitions in the frame of reference of the toning shell 18. Additionally, the chain walk speed depends on the distance "walked" during each pole transition and the frequency of such transitions, a direct result of the rotational speed of the magnetic core 20. Thus:

Developer velocity=shell speed+chain walk speed

Developer velocity=shell speed+chain walk length×frequency

The chain walk length, i.e., the distance the carrier chains walk during each magnetic pole transition, also depends on the amount of excess free volume on the toning shell 18 or in the toning nip 34. Excess free volume is defined as the empty space in the developer nap 38 or in the toning nip 34 not occupied by toner or carrier or the structure the toner and carrier form when clustered together on the open, unbounded areas of the toning shell 18 or under the compressive forces exerted in the toning nip 34. Inside the toning nip 34, the excess free volume is limited by the spacing between the imaging member 12 and the toning shell 18. The amount of excess free volume, in turn, determines the distance a given carrier chain 40 is able to walk. Theoretically, a carrier chain 40 disposed in 100% excess free volume can walk 180°, while a carrier chain 40 disposed in 0% excess free volume cannot walk at all. The more realistic situation of 50% excess free volume allows a carrier chain 40 to walk essentially 90°. Furthermore, the action of the carrier particle chains 40 forming, rotating and collapsing acts to agitate the developer 16, freeing toner particles from the carrier particles to interact with the imaging member 12. Nap 38 density and agitation are optimized at an excess free volume of 50%.

To a first-order approximation, the chain walk length is proportional to the nap 38 height measured outside the toning nip 34 and the excess free volume fraction outside the toning nip 34. Therefore, for a toning station having a rotating magnetic core 20 with M poles and a rotating toning shell 18:

Developer velocity=shell speed+nap height×free volume fraction×(shell RPM/60+core RPM/60)×$M$ (1)

where the free volume fraction is the volume not occupied by the toner and carrier particles or the structure they form, divided by the total volume available. Additionally, the nap 38 height measured outside the toning nip 34 indicates the amount of developer 16 that will be moved by a single pole transition. Outside the toning nip 34, the total volume per unit area corresponds to the nap 38 height, while inside the toning nip 34, the total volume per unit area is determined by the imaging member 12 spacing from the toning shell 18. In an exemplary embodiment, this spacing is nominally 0.014" but, given the flexibility of the film imaging member 12, the spacing is actually about 0.018".

The fraction of volume occupied by the toner and carrier particles in the toning nip 34 may be calculated by assuming that the volume in the toning nip 34 is limited by the actual spacing of the imaging member 12 from the toning shell 18 of 0.018", calculating the actual volume occupied by each developer particle, and dividing this volume by the packing fraction, f, for dense randomly packed spheres. For dense random packing, f~0.6. The toner and carrier particles are assumed to be spherical, and their volume is given by the equations:

$$V_T=(4/3)\pi r_T^3$$

$$V_C=(4/3)\pi r_C^3$$

The number of toner particles in a given unit area of developer, $N_T$, and the number of carrier particles in a given unit area of developer, $N_C$, are given by the following equations:

$$N_T=DMAD\times TC/(\rho_T V_T)$$

$$N_C=DMAD\times(1-TC)/(\rho_C V_C)$$

where DMAD is the developer mass area density, TC is fractional toner content of the developer by weight, $\rho_T$ is density of the toner particles and $\rho_C$ is density of the carrier particles. Given these values, excess free volume fraction may be calculated by the following equation:

$$V_F=1-(kN_T V_T+N_C V_C)/(fL)$$

where L is the spacing between the imaging member 12 and the toning shell 18 and k is the interstitial toner fraction, i.e., the fraction of the toner particles that do not fit within the interstitial spaces, or voids, created between the carrier particles when the carrier particles are packed together and, therefore, contribute to the volume taken up by the developer 16. The amount of available excess free volume, both in and out of the toning nip, is thus largely dependent on the degree to which the toner particles are able to fit into the voids created in packing of the carrier particles. If the toner particles are smaller than the voids created by the packing of the carrier particles, the volume taken up by the developer is almost entirely dependent on the carrier particles. It may be seen, however, that, as the diameter of the toner particles increases relative to the diameter of the carrier particles, the ability of the toner particles to fit into the voids in the carrier particle packing structure diminishes and the toner particles increasingly contribute to the overall developer volume, decreasing free volume. In other words, if the toner particles are much smaller in diameter than the carrier particles, the toner particles are much smaller than these void structures and easily fit within the voids, and the excess free volume results essentially from the size of the carrier particles, with little or no contribution from the toner particles, and k is essentially 0. If, however, the toner particles are sized relative to the carrier particles such that the toner particles are large enough that they either just fit within the void or are slightly too large to fit within the void, the toner particles contribute to the overall excess free volume, and k approaches 1. For toner particles of diameter greater than about 41% of the carrier particle diameter, k~1, and for the toner used in experiments reported herein and for these calculations, it was assumed that k=1.

Outside the toning nip 34, the developer nap is not subjected to the compression forces present in the toning nip 34 and, therefore, the packing fraction, f, is less than 0.6. It may be assumed that the packing structure of the nap outside the toning nip 34 results from magnetic attraction by the carrier particles and that relatively large toner particles will occupy voids in the packing structure of the carrier particles larger in size than the average toner particle and smaller in size than the average carrier particle. Thus:

$$V_F=1-(kN_{Tj}V_C+N_CV_C)/(fH)$$

where H is the measured nap height. Parameter j is the average void size of $j\times V_C$ that is occupied by a toner particle outside the toning nip 34, and $V_T/V_C \leqq j \leqq 1$. For this calculation, $V_T/V_C=0.09$, and it was assumed that j=0.6, resulting in a void size greater than half the volume of a carrier particle. For toner particles having a much smaller diameter relative to the diameter of the carrier particles, the packing structure of the developer particles would be determined entirely by the carrier particles, and the toner particles would not contribute to the developer volume.

Finally, since the average developer bulk velocity in the toning nip 34 must equal developer bulk velocity in the nap 38, i.e., on the toning shell 18 outside the toning nip 34, to avoid a build-up of developer 16 somewhere in the system:

$$L/H \geqq (kN_TV_T+N_CV_C)/(kN_{Tj}Vc+N_CV_C)$$

where L is the spacing between the imaging member 12 and the toning shell 18, and H is the nap 38 height.

Thus, the above equations may be used to derive the desired average developer bulk velocity, which may then be matched to the imaging member velocity, either by manipulating the imaging member velocity to match the developer velocity or by manipulating the toning shell velocity and/or magnetic core velocity and or skive spacing 27 to adjust the average developer bulk velocity to the imaging member velocity.

EXAMPLES

In the following examples, average developer bulk velocity, $V_{dev}$, was determined by dividing the developer flow rate by the developer mass area density, DMAD. The developer flow rate (g/in sec.) was measured on a benchtop toning station by running the toning station and collecting the developer from the toning shell in a 1 inch wide hopper for a fixed time, typically 0.5 seconds. The amount of developer collected per inch of hopper is divided by the time to determine the developer flow rate. DMAD was determined by abruptly stopping the toning station, placing a template having a one square inch cutout over the toning shell and removing the developer inside the cutout with a magnet or a vacuum. The collected developer was weighed and the mass was divided by the area to yield DMAD ($g/in^2$).

Nap height was measured on a benchtop toning station using a Keyence LX2-11 laser and detector (Keyence Corporation of America, 649 Gotham Parkway, Carlstadt, N.J. 07072). This device produces a voltage based on the height of the transmitted laser beam, comparing the height of the beam in the presence and absence of an intervening obstruction to determine the height of the obstruction, in this case the developer nap. The maximum difference between the two measurements indicates the height of the developer nap.

The toner used in these examples had a volume average diameter of approximately 11.5 microns, with individual particles having a density of approximately 1 g/cc. The magnetic carrier used in these examples had a volume average diameter of approximately 26 microns and individual carrier particles had a density of approximately 3.5 g/cc. The toner concentration of the developer was 10% by weight, and the imaging member spacing was nominally set at 0.014 inches, although given the flexibility of the imaging member, the actual spacing was approximately 0.018 inches.

An experiment was conducted to compare the average developer bulk velocity to the imaging member velocity for two different setpoints. The first setpoints approximate a commercial toning station operating at 110 pages per minute (ppm), wherein the linear velocity of the developer was matched to the imaging member speed, i.e., where the shell speed and magnetic core speed were set to make the velocity at the end of a carrier particle chain in the toning nip equal to the velocity of the imaging member when the end of the carrier chain was moving parallel to the imaging member. The second setpoints were determined as set forth herein, for 142 ppm. These settings are summarized in Table I, Table II reports the results calculated using free volume while Table III reports the measured results.

TABLE I

| Type | Film Speed (inches/sec) | Skive Spacing | Shell Speed (inches/sec) | Shell speed (rpm) | Core Speed (rpm) |
|---|---|---|---|---|---|
| 110 ppm | 17.48 | 0.031" | 6.3 | 60 | 1100 |
| 142 ppm | 23.04 | 0.025" | 17.23 | 165 | 1100 |

TABLE II

| Type | Film Speed (inches/sec) | Measured $V_{DEV}$ | Nip Free Volume Fraction | Calculated $V_{DEV}$ | Free Volume Fraction Outside Nip | Calculated $V_{DEV}$ Outside Nip |
|---|---|---|---|---|---|---|
| 110 ppm | 17.48 | 6.43 | 0.05 | 6.97 | 0.05 | 7.00 |
| 142 ppm | 23.04 | 24.54 | 0.52 | 24.52 | 0.52 | 24.52 |

TABLE III

| Type | Film Speed (inches/sec) | Nap Height | Dev. flow (g/in sec) | DMAD (g/in$^2$) | $V_{dev}$ (in/sec) |
|---|---|---|---|---|---|
| 110 ppm | 17.48 | 0.04804" | 3.02 | 0.47 | 6.43 |
| 142 ppm | 23.04 | 0.04791" | 5.89 | 0.24 | 24.54 |

The results reported in Tables I–III show that the linear velocity method results in an average developer bulk velocity 63% below imaging member velocity, whereas the method set forth herein results in a developer bulk velocity within 7% of imaging member velocity.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. For example, the invention can be used with electrophotographic or electrographic images. The invention can be used with imaging elements or imaging members in either web or drum formats. Optimized setpoints for some embodiments may be attained using reflection density instead of transmission density, and the exact values of optimum setpoints may depend on the geometry of particular embodiments or particular characteristics of development in those embodiments. It is therefore intended to include within the invention all such variations and modifications as fall within the scope of the appended claims and equivalents thereof.

We claim:

1. An electrographic printer, comprising:

an imaging member moving at a predetermined velocity, a toning shell located adjacent the imaging member and defining an image development area therebetween; and a multipole magnetic core located adjacent the toning shell;

wherein developer is caused to move through the image development area in the direction of imaging member travel at an average developer bulk velocity greater than about 37% of the imaging member velocity;

the developer comprising a mixture of toner and hard magnetic carriers.

2. The electrographic printer of claim 1, wherein the average developer bulk velocity is greater than about 50% of the imaging member velocity.

3. The electrographic printer of claim 1, wherein the average developer bulk velocity is greater than about 75% of the imaging member velocity.

4. The electrographic printer of claim 1, wherein the average developer bulk velocity is greater than about 90% of the imaging member velocity.

5. The electrographic printer of claim 1, wherein the average developer bulk velocity is between about 40% and about 130% of the imaging member velocity.

6. The electrographic printer of claim 1, wherein the average developer bulk velocity is between about 75% and about 125% of the imaging member velocity.

7. The electrographic printer of claim 1, wherein the average developer bulk velocity is between about 90% and about 110% of the imaging member velocity.

8. The electrographic printer of claim 1, wherein the average developer bulk velocity is substantially equal to the imaging member velocity.

9. The electrographic printer of claim 1, wherein the magnetic core produces a magnetic field having a field vector that rotates in space.

10. An electrographic printer, comprising:

an imaging member moving at a predetermined velocity, a rotating toning shell located adjacent the imaging member and defining an image development area therebetween, the toning shell rotating such that the toning surface opposite the imaging member travels cocurrently with the imaging member;

a multipole magnetic core located inside the toning shell; and developer, wherein the developer is caused to move through the image development area in the direction of imaging member travel at a developer average bulk velocity greater than about 37% of the imaging member velocity.

11. The electrographic printer of claim 10, wherein the average developer bulk velocity is greater than about 50% of the imaging member velocity.

12. The electrographic printer of claim 10, wherein the average developer bulk velocity is greater than about 75% of the imaging member velocity.

13. The electrographic printer of claim 10, wherein the average developer bulk velocity is greater than about 90% of the imaging member velocity.

14. The electrographic printer of claim 10, wherein the average developer bulk velocity is between about 40% and about 130% of the imaging member velocity.

15. The electrographic printer of claim 10, wherein the average developer bulk velocity is between about 75% and about 125% of the imaging member velocity.

16. The electrographic printer of claim 10, wherein the average developer bulk velocity is between about 90% and about 110% of the imaging member velocity.

17. The electrographic printer of claim 10, wherein the average developer bulk velocity is substantially equal to the imaging member velocity.

18. An electrographic printer, comprising:

an imaging member moving at a predetermined velocity, a rotating toning shell located adjacent the imaging member and defining an image development area therebetween, the toning shell rotating such that the toning surface opposite the imaging member travels cocurrently with the imaging member;

a rotating multipole magnetic core located inside the toning shell, the magnetic core rotating in a direction opposite to the direction of toning shell rotation; and developer, wherein the developer is caused to move through the image development area in the direction of imaging member travel at an average developer bulk velocity greater than about 37% of the imaging member velocity.

19. The electrographic printer of claim 18, wherein the average developer bulk velocity is greater than about 50% of the imaging member velocity.

20. The electrographic printer of claim 18, wherein the average developer bulk velocity is greater than about 75% of the imaging member velocity.

21. The electrographic printer of claim 18, wherein the average developer bulk velocity is greater than about 90% of the imaging member velocity.

22. The electrographic printer of claim 18, wherein the average developer bulk velocity is between about 40% and about 130% of the imaging member velocity.

23. The electrographic printer of claim 18, wherein the average developer bulk velocity is between about 75% and about 125% of the imaging member velocity.

24. The electrographic printer of claim 18, wherein the average developer bulk velocity is between about 90% and about 110% of the imaging member velocity.

25. The electrographic printer of claim 18, wherein the average developer bulk velocity is substantially equal to the imaging member velocity.

26. A method for generating electrographic images, the method comprising the steps of:

a) providing an electrographic printer comprising an imaging member moving at a predetermined velocity, a toning shell located adjacent the imaging member and defining an image development area therebetween, and a multipole magnetic core located inside the toning shell;

b) causing developer to move through the image development area in the direction of imaging member travel at an average developer bulk velocity greater than about 37% of the imaging member velocity;

the developer comprising a mixture of toner and hard magnetic carriers.

27. The method of claim 26, wherein the average developer bulk velocity is greater than about 50% of the imaging member velocity.

28. The method of claim 26, wherein the average developer bulk velocity is greater than about 75% of the imaging member velocity.

29. The method of claim 26, wherein the average developer bulk velocity is greater than about 90% of the imaging member velocity.

30. The method of claim 26, wherein the developer average bulk velocity is between about 40% and about 130% of the imaging member velocity.

31. The method of claim 26, wherein the average developer bulk velocity is between about 75% and about 125% of the imaging member velocity.

32. The method of claim 26, wherein the average developer bulk velocity is between about 90% and about 110% of the imaging member velocity.

33. The method of claim 26, wherein the average developer bulk velocity is substantially equal to the imaging member velocity.

34. A method for generating electrographic images, the method comprising the steps of:

a) providing an electrographic printer comprising an imaging member moving at a predetermined velocity, a rotating toning shell located adjacent the imaging member, and defining an image development area therebetween, the toning shell rotating in a direction such that the surface of the toning shell opposite the imaging member travels in the direction of imaging member travel, and a multipole magnetic core located inside the toning shell;

b) causing developer to move through the image development area in the direction of imaging member travel at an average developer bulk velocity greater than about 37% of the imaging member velocity.

35. The method of claim 34, wherein the average developer bulk velocity is greater than about 50% of the imaging member velocity.

36. The method of claim 34, wherein the average developer bulk velocity is greater than about 75% of the imaging member velocity.

37. The method of claim 34, wherein the average developer bulk velocity is greater than about 90% of the imaging member velocity.

38. The method of claim 34, wherein the average developer bulk velocity is between 40% and 130% of the imaging member velocity.

39. The method of claim 34, wherein the average developer bulk velocity is between 75% and 125% of the imaging member velocity.

40. The method of claim 34, wherein the average developer bulk velocity is between about 90% and about 110% of the imaging member velocity.

41. The method of claim 34, wherein the average developer bulk velocity is substantially equal to the imaging member velocity.

42. A method for generating electrographic images, the method comprising the steps of:

a) providing an electrographic printer comprising an imaging member moving at a predetermined velocity, a rotating toning shell located adjacent the imaging member, and defining an image development area therebetween, the toning shell rotating in a direction such that the surface of the toning shell opposite the imaging member travels in the direction of imaging member travel, and a multipole magnetic core located inside the toning shell;

b) causing developer to move through the image development area in the direction of imaging member travel at an average developer bulk velocity greater than about 37% of the imaging member velocity.

43. The method of claim 42, wherein the average developer bulk velocity is greater than about 50% of the imaging member velocity.

44. The method of claim 42, wherein the average developer bulk velocity is greater than about 75% of the imaging member velocity.

45. The method of claim 42, wherein the average developer bulk velocity is greater than about 90% of the imaging member velocity.

46. The method of claim 42, wherein the average developer bulk velocity is between about 40% and about 130% of the imaging member velocity.

47. The method of claim 42, wherein the average developer bulk velocity is between about 75% and about 125% of the imaging member velocity.

48. The method of claim 42, wherein the average developer bulk velocity is between about 90% and about 110% of the imaging member velocity.

49. The method of claim 42, wherein the average developer bulk velocity is substantially equal to the imaging member velocity.

50. An electrographic printer, comprising:

an imaging member moving at a predetermined velocity, a toning shell located adjacent the imaging member and defining an image development area therebetween; and a multipole magnetic core located adjacent the toning shell;

wherein developer is caused to move through the image development area in the direction of imaging member travel at an average bulk velocity wherein the developer flow in gm/(in. sec.) divided by the developer mass area density in gm/in$^2$ is greater than about 37% of the imaging member velocity;

the developer comprising a mixture of toner and hard magnetic carriers.

51. The electrographic printer of claim 50 wherein the developer is caused to move through the image development area in the direction of imaging member travel at an average bulk velocity wherein the developer flow in gm/(in. sec.) divided by the developer mass area density in gm/in$^2$ is between about 75% and 125% of the imaging member velocity.

52. The electrographic printer of claim 50 wherein the developer is caused to move through the image development area in the direction of imaging member travel at an average bulk velocity such that wherein the developer flow in gm/(in. sec.) divided by the developer mass area density in gm/in$^2$ is between about 90% and 110% of the imaging member velocity.

53. The electrographic printer of claim 50 wherein the developer is caused to move through the image development area in the direction of imaging member travel at an average bulk velocity such that wherein the developer flow in gm/(in. sec.) divided by the developer mass area density in gm/in$^2$ is substantially equal to the imaging member velocity.

54. An electrographic printer, comprising:

an imaging member moving at a predetermined velocity, a toning shell located adjacent the imaging member and defining an image development area therebetween; and a multipole magnetic core located adjacent the toning shell;

wherein developer is caused to move through the image development area in the direction of imaging member travel with excess free volume in the image development area between about 7% and about 93%.

55. The electrographic printer of claim 54, wherein developer is caused to move through the image development area in the direction of imaging member travel with excess free volume in the image development area between about 25% and about 75%.

56. The electrographic printer of claim 54, wherein developer is caused to move through the image development area in the direction of imaging member travel with excess free volume in the image development area is about 50%.

57. The electrographic printer of claim 54, wherein the fraction of excess free volume ($V_F$) in the toning nip is determined by the equation $V_F=1-(kN_TV_T+N_CV_C)/(fL)$; wherein k is an interstitial toner fraction, $N_T$ is a number of toner particles in a given unit area of said developer; $V_T$ is a toner particle volume, $N_C$ is a number of carrier particles in a given unit area of said developer, $V_C$ is a carrier particle volume, f is a packing fraction, and L is a spacing between said imaging member and said toning shell.

58. The electrographic printer of claim 54, wherein the fraction of excess free volume on the toning shell is determined by the equation $V_F=1-(kN_TjV_C+N_CV_C)/(fH)$; wherein k is an interstitial toner fraction, $N_T$ is a number of toner particles in a given unit area of said developer; $jV_C$ is an average void size occupied by a toner particle, $N_C$ is a number of carrier particles in a given unit area of said developer, $V_C$ is a carrier particle volume, f is a packing fraction, and H is a measured nap height.

59. The electrographic printer of claim 57 wherein k is equal to about 1.0.

60. The electrographic printer of claim 57 wherein k is between about 0.0 and about 1.0.

61. The electrographic printer of claim 58 wherein k is equal to about 1.0.

62. The electrographic printer of claim 58 wherein k is between about 0.0 and about 1.0.

63. A method for generating electrographic images, the method comprising the steps of:

a) providing an electrographic printer comprising an imaging member moving at a predetermined velocity, a toning shell located adjacent the imaging member, and defining an image development area therebetween, and a multipole magnetic core located inside the toning shell;

b) causing developer to move through the image development area in the direction of imaging member travel at an average developer bulk velocity that there is substantially no relative motion of the developer in the process direction with reference to the imaging member; and c) developer is caused to move in a direction normal to the direction of developer bulk flow by agitation.

64. An electrographic printer, comprising: an imaging member moving at a predetermined velocity, a toning shell located adjacent the imaging member and defining an image development area therebetween; and a multipole magnetic core located adjacent the toning shell; wherein developer is caused to move on the toning shell in the process direction with an excess free volume fraction between about 0.07 and about 0.93.

65. The electrographic printer of claim 64, wherein the excess free volume fraction is between about 0.25 and about 0.75.

66. The electrographic printer of claim 64, wherein the excess free volume fraction is about 0.50.

67. The electrographic printer of claim 64, wherein the imaging member spacing from the toning shell and the nap height conform to the equation $L/H \geqq (kN_TV_T+N_CV_C)/(kN_TjV_C+N_CV_C)$, where L is the spacing between the imaging member and the toning shell, and H is the nap height; and wherein k is an interstitial toner fraction, $N_T$ is a number of toner particles in a given unit area of said developer; $V_T$ is a toner particle volume, $N_C$ is a number of carrier particles in a given unit area of said developer, $V_C$ is a carrier particle volume, and $jV_C$ is an average void size occupied by a toner particle.

68. The apparatus of claim 1, wherein said multipole magnetic core is rotated.

69. The apparatus of claim 26, further comprising rotating said multipole magnetic core.

70. The apparatus of claim 50, further comprising rotating said multipole magnetic core.

71. The apparatus of claim 58, wherein $j \geqq V_T/V_C$.

72. The apparatus of claim 67, wherein $j \geqq V_T/V_C$.

* * * * *